US008943934B2

(12) United States Patent
Brooks et al.

(10) Patent No.: US 8,943,934 B2
(45) Date of Patent: Feb. 3, 2015

(54) APPARATUS AND METHOD FOR REMOVING BOARD EDGE WASTE STRIPS IN A RIPSAWING OPERATION

(75) Inventors: Louis R. Brooks, Signal Mtn., TN (US); Dan V. Stocke, Sequatchie, TN (US)

(73) Assignee: Hasko Machines, Soddy Daisy, TN (US)

( * ) Notice: Subject to any disclaimer, the term of this patent is extended or adjusted under 35 U.S.C. 154(b) by 718 days.

(21) Appl. No.: 13/273,706

(22) Filed: Oct. 14, 2011

(65) Prior Publication Data

US 2013/0091995 A1 Apr. 18, 2013

(51) Int. Cl.

| | |
|---|---|
| ***B26D 7/18*** | (2006.01) |
| ***B26D 1/03*** | (2006.01) |
| ***B27B 31/08*** | (2006.01) |
| ***B27B 5/04*** | (2006.01) |

(52) U.S. Cl.

CPC . *B27B 31/08* (2013.01); *B26D 7/18* (2013.01); *B26D 7/1854* (2013.01); *B27B 5/04* (2013.01)

USPC ..... 83/13; 83/24; 83/99; 83/102; 83/425.2; 144/237

(58) Field of Classification Search

CPC ..... B07C 5/363; B07C 1/18; B26D 7/18; B26D 7/1854; B26D 7/1863; B26D 7/0658; B26D 2001/0033; B26D 1/03; B26D 1/035; B26D 1/14; B26D 1/143

USPC ..... 83/24, 27, 98, 99, 102, 109, 111, 112, 83/155, 425, 425.2–425.4, 13, 155.1; 144/376, 237; 209/44.2, 644, 932

See application file for complete search history.

(56) References Cited

U.S. PATENT DOCUMENTS

| | | | | |
|---|---|---|---|---|
| 4,270,423 | A * | 6/1981 | Angelo | 83/102.1 |
| 4,823,664 | A * | 4/1989 | Cooper et al. | 83/367 |
| 4,881,584 | A * | 11/1989 | Wislocker et al. | 144/39 |
| 6,313,422 | B1 * | 11/2001 | Anibas | 209/580 |
| 6,506,991 | B1 * | 1/2003 | Eixelberger et al. | 209/581 |
| 6,637,600 | B2 * | 10/2003 | Miyamoto et al. | 209/539 |
| 6,877,411 | B2 * | 4/2005 | McGehee et al. | 83/425.4 |
| 2007/0194258 | A1 * | 8/2007 | Brandmeier | 250/573 |
| 2008/0105597 | A1 * | 5/2008 | Miller et al. | 209/1 |
| 2011/0079324 | A1 * | 4/2011 | Appeldoorn et al. | 144/376 |

* cited by examiner

*Primary Examiner* — Phong Nguyen

(74) *Attorney, Agent, or Firm* — Alston & Bird LLP

(57) ABSTRACT

A waste strip-removing apparatus for use with a ripsaw that saws an incoming board into one or more usable boards and removes the opposite side edges, which become two waste strips that must be removed and transported to a different destination from that to which the usable board(s) is (are) transported. The apparatus includes two air-blasting units each having one or more air nozzles assigned to each waste strip. The air-blasting units are positioned with respect to a lateral direction by a positioning mechanism so that air directed from the nozzles impinges on the waste strips and moves them laterally away from the usable board(s). The positioning mechanism can include a linear motor having two forcers movable along a platen and respectively attached to air-blasting units.

21 Claims, 8 Drawing Sheets

APPARATUS AND METHOD FOR REMOVING BOARD EDGE WASTE STRIPS IN A RIPSAWING OPERATION

BACKGROUND OF THE INVENTION

The present application relates generally to ripsawing operations in which a wide incoming board is sawed into a plurality of narrower boards for uses such as flooring, moldings, furniture, and the like, and in which the opposite edges are removed to become waste strips. The application more particularly relates to an apparatus and an associated method for removing these waste strips after they have been separated from the incoming board, so that the waste strips can be routed to one destination while the sawn boards are routed to a different destination.

Typical hardwood rip optimization systems utilize either a moving fence with fixed saws or a fixed fence with shifting saws to obtain the targeted solution for ripped lumber. In either case most of these systems are designed to rip random-length lumber for best material yield by determining the optimum number of targeted widths that can be obtained from the incoming board. Every board ripped in a wood-ripping optimizing process produces one or more usable targeted widths and two waste strips constituted by the opposite edges. These waste strips can be located at various positions on the outfeed conveyor depending on the rip pocket location and/or the width of the incoming board. These waste strips are moving at the speed of the boards being sawed, which typically is from about 50 to about 500 fpm.

These waste strips must be located, removed, and deposited onto a waste conveyor as they are produced. The removal process up until now has been done either manually or with some type of mechanical assist. This is an ineffective use of expensive labor, but more importantly, a critical and hazardous operation.

BRIEF SUMMARY OF THE INVENTION

The present disclosure describes an apparatus for use in a ripsawing operation in which an incoming board is fed lengthwise along a longitudinal direction into a ripsaw and is sawn to produce one or more usable boards and in which opposite edges of the incoming board are removed to become two waste strips. As is typical in such a ripsawing operation, the usable board(s) and the waste strips are carried away from the ripsaw atop an outfeed conveyor that conveys the usable board(s) and the waste strips in the longitudinal direction. Conventionally, however, the waste strips are removed manually by a worker or workers positioned adjacent the outfeed conveyor. As previously noted, this is an operation that entails not only increased labor cost but also some amount of risk to the worker(s).

The present disclosure describes an apparatus for removing the waste strips and diverting the waste strips along paths different from that of the usable board(s). In one embodiment, the apparatus comprises:

a first air-blasting unit comprising one or more first air nozzles;

a second air-blasting unit comprising one or more second air nozzles; and a positioning mechanism that positions the first and second air-blasting units generally above the outfeed conveyor, the positioning mechanism comprising a linear movement mechanism operable for independently adjusting the positions of the first and second air-blasting units with respect to a lateral direction that is generally transverse to the longitudinal direction, such that air from the first air nozzle(s) impinges on one of the waste strips to move the waste strip laterally and away from one side of the usable board(s), and air from the second air nozzle(s) impinges on the other waste strip to move the waste strip laterally and away from the other side of the usable board(s).

The linear movement mechanism in accordance with one embodiment comprises a linear motor, the linear motor comprising a platen extending parallel to the lateral direction and first and second forcers movable along the platen. The first forcer is fastened to the first air-blasting unit and the second forcer is fastened to the second air-blasting unit, such that actuation of the linear motor causes the forcers to be moved to commanded positions along the platen, thereby adjusting the positions of the air-blasting units.

Any of various linear motor types can be used, but in one advantageous embodiment the linear motor comprises a brushless linear motor, the at least one platen comprising a magnet track and the forcers comprising primary coils.

As an alternative to a linear motor of the type described above, the linear movement mechanism instead can comprise, for example, a ball screw driven by any suitable drive arrangement (e.g., servo, rotary belt, etc.), or a pneumatic cylinder, etc. The particular construction of the linear movement mechanism is not critical to the present invention.

The positioning mechanism can include a linear bearing assembly having at least a first linear bearing shaft extending parallel to the platen, the first and second air-blasting units engaging the first linear bearing shaft so as to be slidable therealong in the lateral direction.

In one embodiment, the first air-blasting unit comprises a plurality of first air nozzles, and the second air-blasting unit comprises a plurality of second air nozzles.

The first air nozzles can include at least one downwardly aimed air nozzle for separating the respective waste strip from the usable board(s) and at least one downwardly and laterally outwardly aimed air nozzle for moving the waste strip laterally and away from the usable board(s). The second air nozzles similarly can include at least one downwardly aimed air nozzle for separating the respective waste strip from the usable board(s) and at least one downwardly and laterally outwardly aimed air nozzle for moving the waste strip laterally and away from the usable board(s).

In an embodiment described herein, the first air-blasting unit comprises a first support arm extending longitudinally, with the first air nozzles being mounted on the first support arm, and the second air-blasting unit comprises a second support arm extending longitudinally, with the second air nozzles being mounted on the second support arm.

In a particular embodiment described herein, the first air nozzles comprise an upstream pair of downwardly aimed and downwardly and laterally outwardly aimed air nozzles mounted on an upstream portion of the first support arm and a downstream pair of downwardly aimed and downwardly and laterally outwardly aimed air nozzles mounted on a downstream portion of the first support arm. Similarly, the second air nozzles comprise an upstream pair of downwardly aimed and downwardly and laterally outwardly aimed air nozzles mounted on an upstream portion of the second support arm and a downstream pair of downwardly aimed and downwardly and laterally outwardly aimed air nozzles mounted on a downstream portion of the second support arm.

The linear bearing assembly in one embodiment includes a second linear bearing shaft extending parallel to the platen and longitudinally spaced from the first linear bearing shaft, and each of the first and second support arms is slidably connected to the first and second linear bearing shafts.

The apparatus can include at least one detection device operable to detect a location of each of the waste strips with respect to the lateral direction. The detected locations of the waste strips are used for positioning of the first and second air-blasting units.

The present disclosure also describes a method for use in a ripsawing operation in which an incoming board is fed lengthwise along a longitudinal direction into a ripsaw and is sawn to produce one or more usable boards and in which opposite edges of the incoming board are removed to become two waste strips, the usable board(s) and the waste strips being carried away from the ripsaw atop an outfeed conveyor that conveys the usable board(s) and the waste strips in the longitudinal direction. The method is for removing the waste strips and diverting the waste strips along paths different from that of the usable board(s). In accordance with one embodiment described herein, the method comprises the steps of:

positioning at least one first air nozzle generally above the outfeed conveyor and at least one second air nozzle generally above the outfeed conveyor;

directing air from the at least one first air nozzle to impinge on one of the waste strips and move the waste strip laterally and away from one side of the usable board(s); and directing air from the at least one second air nozzle to impinge on the other waste strip to move the waste strip laterally and away from the other side of the usable board(s).

In one embodiment, the positioning step comprises using a linear movement mechanism to independently adjust the positions of the first and second air nozzles with respect to a lateral direction that is generally transverse to the longitudinal direction, such that the at least one first air nozzle's position corresponds to a position of the one waste strip and the at least one second air nozzle's position corresponds to a position of the other waste strip.

In one embodiment, the step of using the linear movement mechanism comprises using a linear motor comprising a platen extending parallel to the lateral direction and first and second forcers movable along the platen, wherein movement of the first forcer along the platen is used for imparting movement to the at least one first air nozzle and movement of the second forcer along the platen is used for imparting movement to the at least one second air nozzle. The positioning step comprises actuating the linear motor to cause the forcers to be moved to commanded positions along the platen, thereby adjusting the positions of the air nozzles.

The method in some embodiments is such that, in response to a change in the position of one or both of the waste strips in comparison to the positions of previous waste strips from a previous ripsawing operation, the linear motor is actuated to move one or both of the first and second air nozzles to new position(s). The adjustment of the positions of the nozzles can be done "on the fly" as incoming boards are continually fed one after another through the ripsaw and as the boards may be of various widths such that the lateral positions of the waste strips are continually changing from one board to the next. The linear motor is able to make extremely rapid and accurate adjustments to the air nozzle positions to accommodate such operation.

The change in the positions of the waste strips can be detected by at least one detector. The detector can be a board optimization scanner of the ripsaw. Such scanners are used in some ripsaw systems in order to detect the dimensions and characteristics of the incoming board, and a programmed algorithm in a controller determines how to adjust the positions of the saw blades in order to optimize the yield from the board based on the characteristics detected by the scanner. In accordance with some embodiments described herein, the output of the scanner can also be used for determining where to position the air nozzles of the waste strip-removing apparatus.

Alternatively, a dedicated detector (e.g., a photo-cell or the like), or multiple dedicated detectors, can be used for detecting the positions of the waste strips. This embodiment can be useful when the apparatus is used with a ripsaw that does not include a board optimization scanner.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
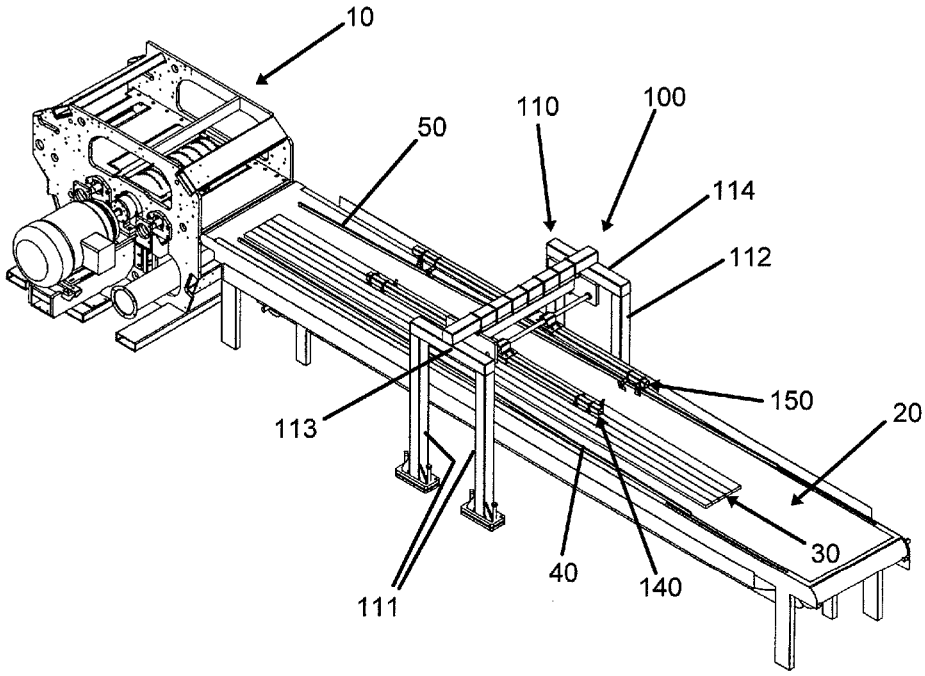
FIG. 1 is an isometric view of an arrangement having a ripsaw, an outfeed conveyor, and a waste strip-removing apparatus in accordance with one embodiment of the invention.
Figure 2:
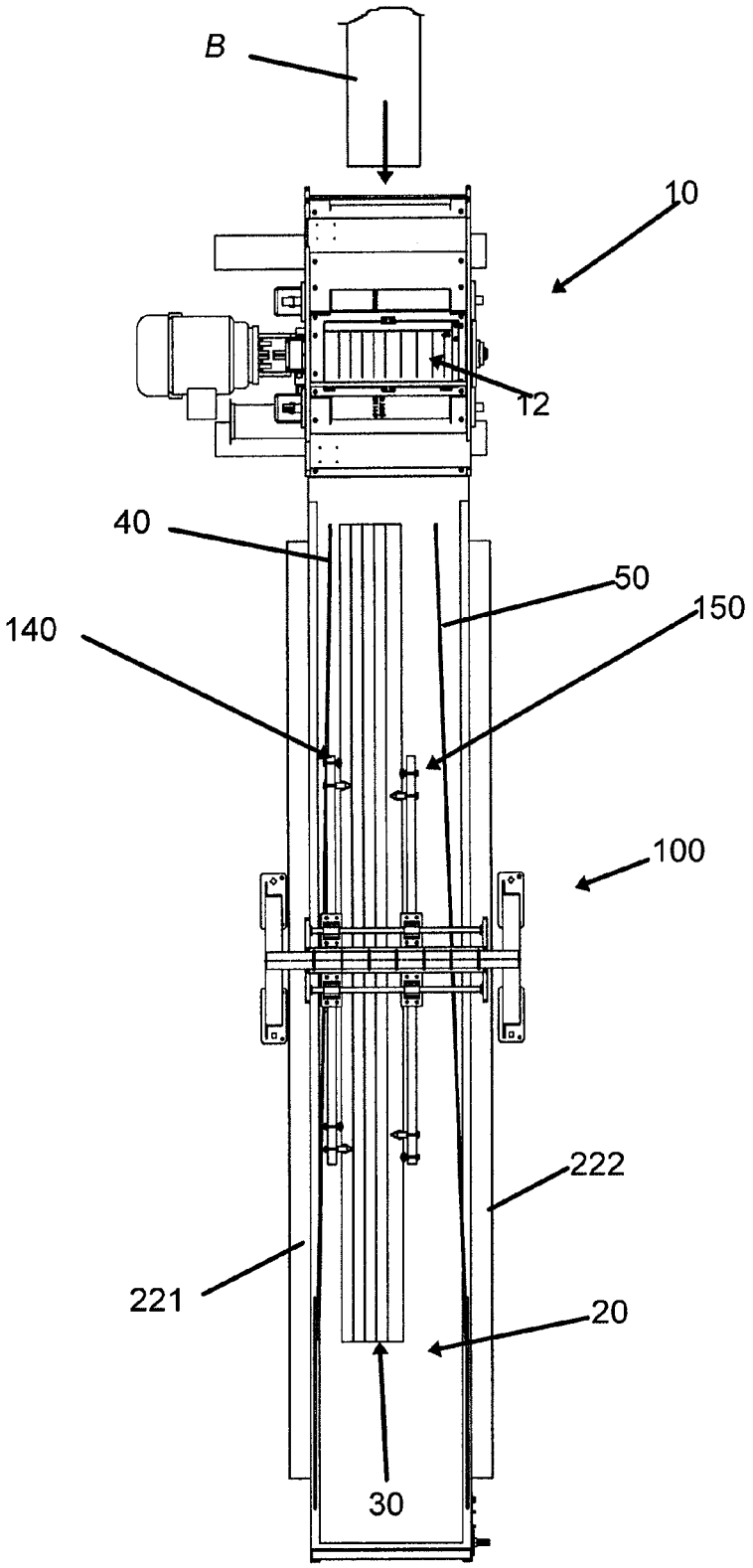
FIG. 2 is a top view of the arrangement of FIG. 1.
Figure 3:
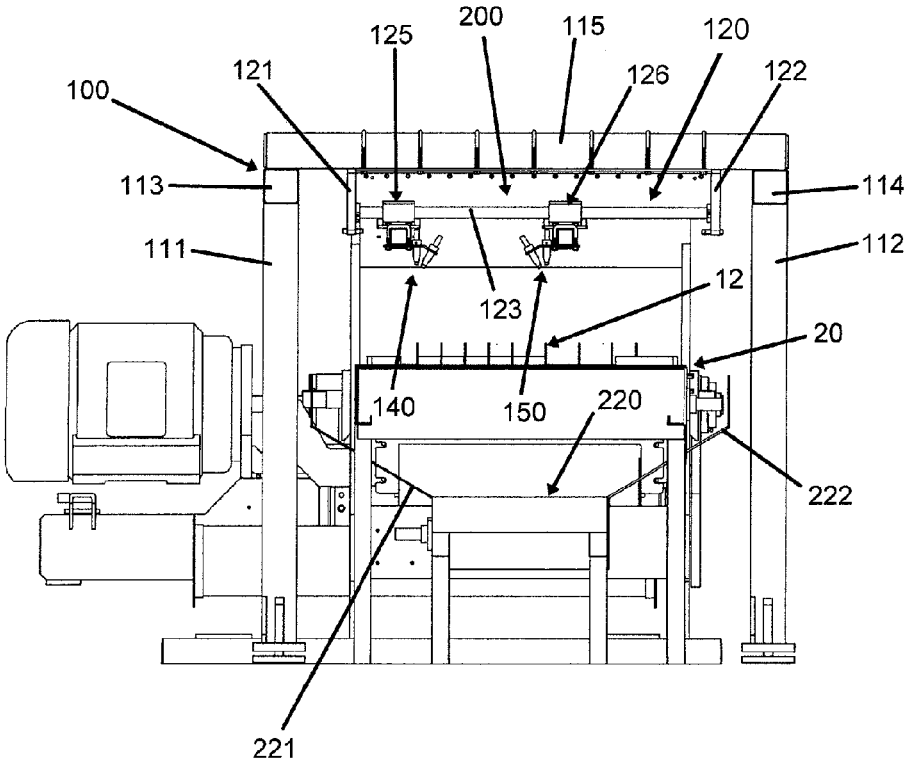
FIG. 3 is an end view of the arrangement of FIG. 1.
Figure 4:
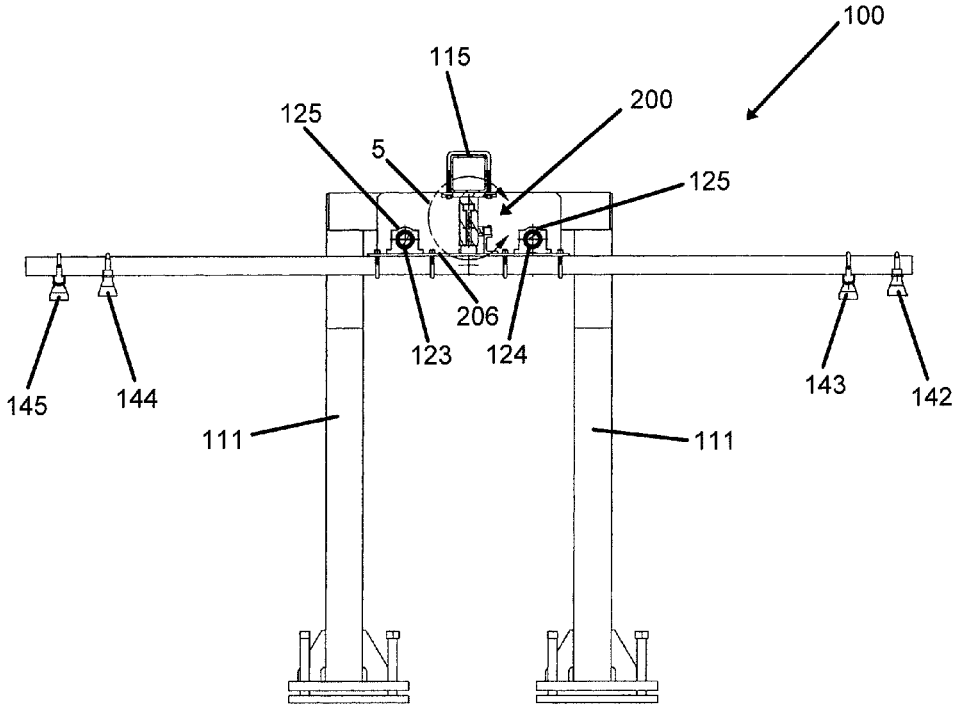
FIG. 4 is a cross-sectional view of the waste strip-removing apparatus in accordance with one embodiment of the invention, along line 4-4 in FIG. 6.

FIGS. 1 through 3 depict various views of an arrangement having a ripsaw 10, an outfeed conveyor 20, and a waste strip-removing apparatus 100 in accordance with one embodiment of the present invention. The ripsaw 10 can be of various types known in the art, having a plurality of saw blades 12 mounted on a common shaft or arbor, and having provisions for adjusting the positions of the saw blades along the arbor in order to saw an incoming board B (FIG. 2) into one or more usable boards 30 of predetermined width(s). Two of the saw blades are also positioned appropriately, depending on the width of the incoming board and its position with respect to the lateral direction (which is left-to-right in FIG. 2), so as to remove the opposite side edges of the incoming board, which become two waste strips 40 and 50. The usable board(s) 30 and the waste strips 40, 50 are carried away from the ripsaw 10 atop the outfeed conveyor 20 that conveys the usable board(s) and the waste strips in the longitudinal direction (top-to-bottom in FIG. 2). The conveyor 20 advantageously should have a smooth top, in the sense that the conveyor does not hinder the waste strips 40, 50 from sliding laterally on the conveyor 20 when subjected to a lateral force, for reasons that will become apparent in the ensuing description of the waste strip-removing apparatus 100.

Figure 6:
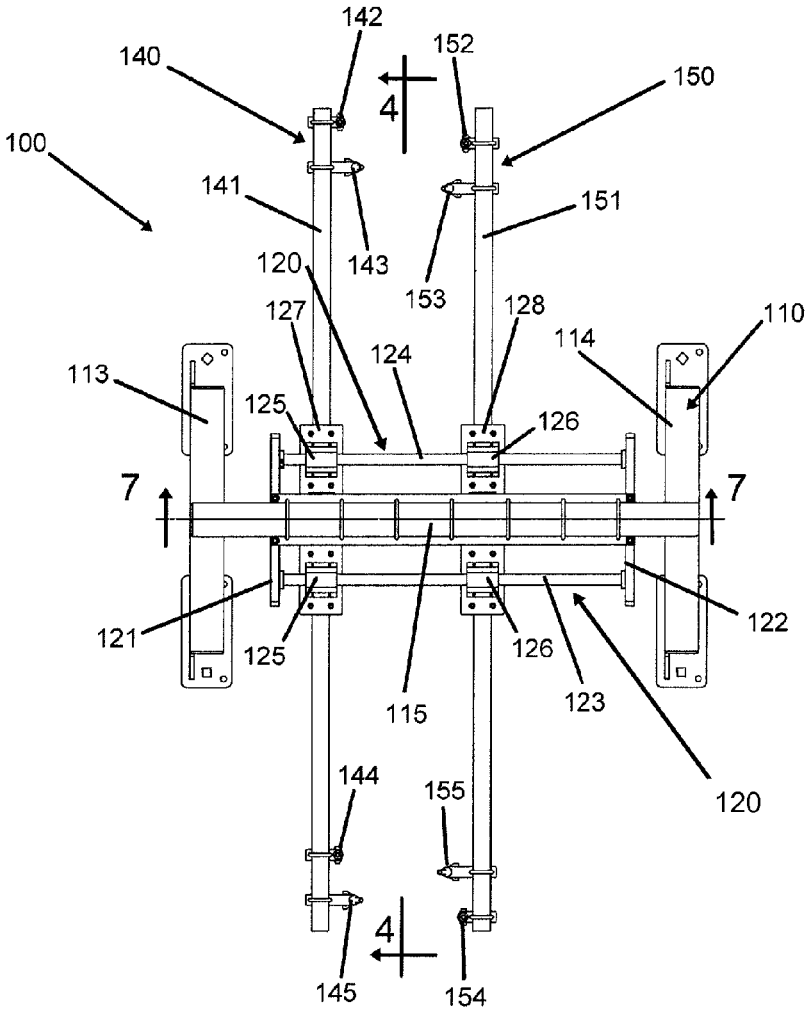
FIG. 6 is a top view of the waste strip-removing apparatus.
Figure 7:
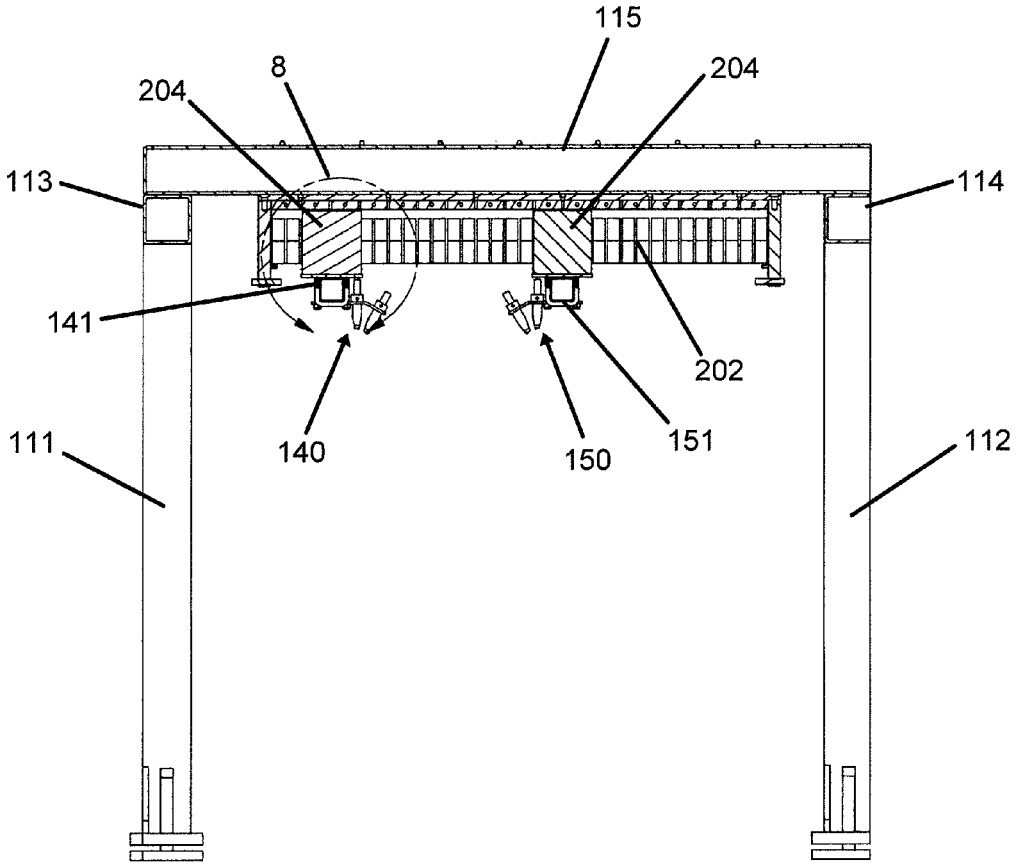
FIG. 7 is a cross-sectional view along line 7-7 in FIG. 6.

With initial reference to FIGS. 1, 6, and 7, the apparatus 100 uses high-velocity air streams to separate the waste strips 40, 50 from the usable board(s) and divert the waste strips 40, 50 along paths different from that of the usable board(s). The apparatus includes a frame 110 made up of two longitudinally spaced left-side uprights 111 and two longitudinally spaced right-side uprights 112 ("left-side" and "right-side" referring to the orientation of the arrangement in FIGS. 1 and 2), the left-side uprights 111 being located adjacent a left side of the outfeed conveyor 20 and the right-side uprights 112 being located adjacent a right side of the conveyor. The frame 110 further includes a left-side longitudinal beam member 113 rigidly connected between the upper ends of the left-side uprights 111 and a right-side longitudinal beam member 114 rigidly connected between the upper ends of the right-side uprights 112, and a transverse beam member 115 rigidly connected between respective longitudinal midpoints of the longitudinal beam members 113 and 114. The transverse beam member 115 is spaced a distance above the upper surface of the conveyor 20.

The apparatus 100 includes a linear bearing assembly 120 rigidly attached to the transverse beam member 115 of the frame. The linear bearing assembly, best seen in FIGS. 3 and 6, includes a left-side linear bearing shaft support bracket 121 rigidly attached to the transverse beam member 115 proximate the left-side longitudinal beam member 113, and a right-side linear bearing shaft support bracket 122 rigidly attached to the transverse beam member 115 proximate the right-side longitudinal beam member 114. The support brackets 121, 122 are located generally below the transverse beam member 115. The linear bearing assembly 120 further includes a first linear bearing shaft 123 rigidly connected between the left-side bracket 121 and the right-side bracket 122 and located generally downstream of the transverse beam member 115, and a second linear bearing shaft 124 rigidly connected between the left-side bracket 121 and the right-side bracket 122 and located generally upstream of the transverse beam member 115 (where "upstream" and "downstream" are with reference to the movement of the conveyor 20 along the longitudinal direction). The two linear bearing shafts 123, 124 are parallel to each other and are generally perpendicular to the longitudinal direction. The shafts 123, 124 have cylindrical outer surfaces, which can include either circular-cylindrical or non-circular-cylindrical surfaces. Examples of non-circular-cylindrical surfaces include oval, elliptical, or polygonal surfaces. It will be evident that the term "cylinder" as used herein thus refers not only to a cylinder of circular cross-section, but more generally to a shape generated by a family of all lines parallel to a given line (the generatrix) and passing through a closed curve lying in a plane (the directrix). The present invention is not limited to any particular configuration for the linear bearing shafts.

The linear bearing assembly 120 further includes a left-side linear bearing 125 and a right-side linear bearing 126 that are mounted on the downstream linear bearing shaft 123 so as to be freely slidable along the shaft, and a left-side linear bearing 125 and a right-side linear bearing 126 that are mounted on the upstream linear bearing shaft 124 so as to be freely slidable along the shaft. Each of the linear bearings 125, 126 defines a bearing passage extending through it, the bearing passage have a cross-sectional shape complementary to the shape of the outer surface of the bearing shaft 123, 124.

Figure 8:
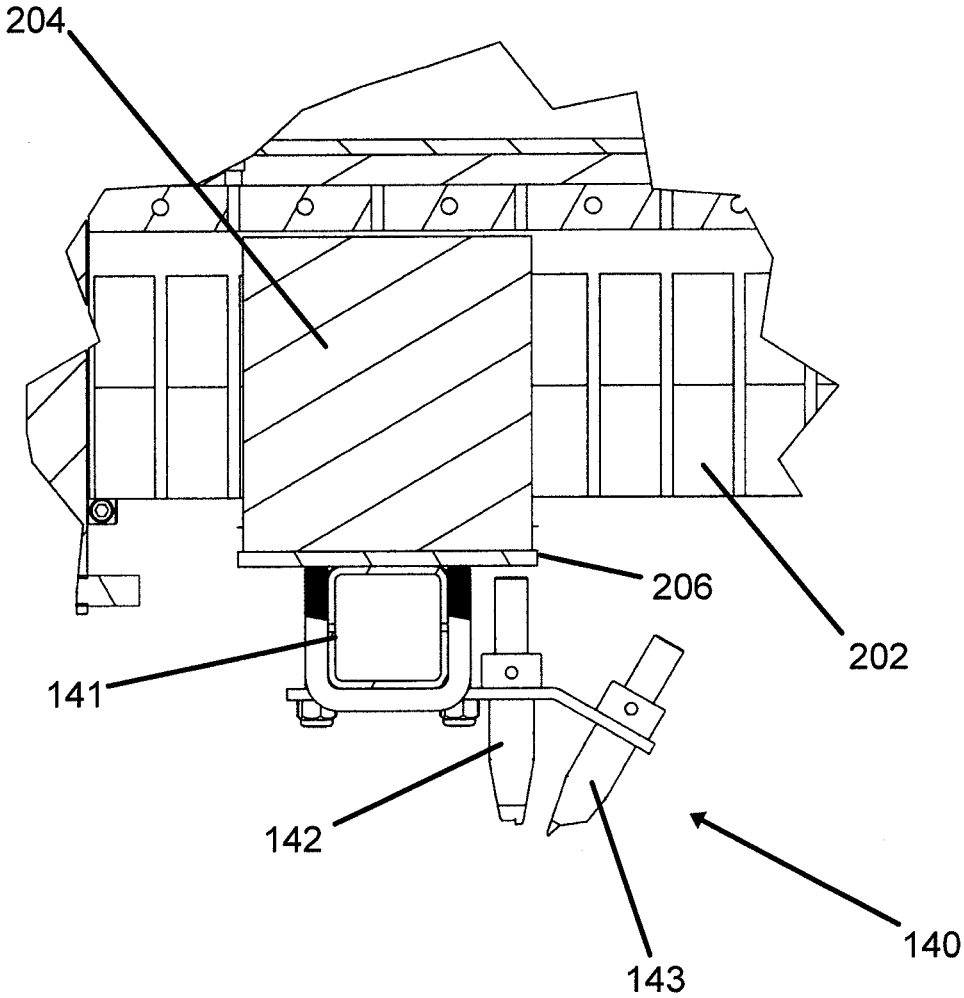
FIG. 8 is a detail view of a portion of FIG. 7 on an enlarged scale relative to FIG. 7.

The apparatus 100 also includes a left-side (or "first") air-blasting unit 140 and a right-side (or "second") air-blasting unit 150. The first air-blasting unit 140 includes an elongate, longitudinally extending first support arm 141 that is rigidly affixed to a bearing mounting plate 127. The mounting plate 127 in turn is rigidly affixed to the two left-side linear bearings 125 such that the lengthwise direction of the support arm 141 is perpendicular to the lengthwise directions of the linear bearing shafts 123, 124. A pair of air nozzles 142 and 143 are rigidly mounted to an upstream end portion of the support arm 141, and another pair of air nozzles 144 and 145 are rigidly mounted to a downstream end portion of the support arm 141. As best seen in FIG. 8, the air nozzle 142 is aimed straight downwardly (i.e., with little or no lateral directional component), while the air nozzle 143 is aimed both downwardly and outwardly (i.e., with both downward and laterally outward directional components). The other pair of air nozzles 144 and 145 similarly are downwardly aimed and downwardly and outwardly aimed, respectively.

The second air-blasting unit 150 is constructed substantially like the first air-blasting unit, and includes an elongate, longitudinally extending second support arm 151 that is rigidly affixed to a bearing mounting plate 128. The mounting plate 128 in turn is rigidly affixed to the two right-side linear bearings 126 such that the lengthwise direction of the support arm 151 is perpendicular to the lengthwise directions of the linear bearing shafts 123, 124 (and thus the two support arms 141, 151 are parallel to each other). A pair of air nozzles 152 and 153 are rigidly mounted to an upstream end portion of the support arm 151, and another pair of air nozzles 154 and 155 are rigidly mounted to a downstream end portion of the support arm 151. The air nozzle 152 is aimed straight downwardly (i.e., with little or no lateral directional component), while the air nozzle 153 is aimed both downwardly and outwardly (i.e., with both downward and laterally outward directional components). The other pair of air nozzles 154 and 155 similarly are downwardly aimed and downwardly and outwardly aimed, respectively.

The first air-blasting unit 140 can slide along the linear bearing shafts 123, 124 in order to position the unit 140 with respect to the lateral direction, and similarly the second air-blasting unit 150 can slide along the linear bearing shafts to position it with respect to the lateral direction.

Figure 5:
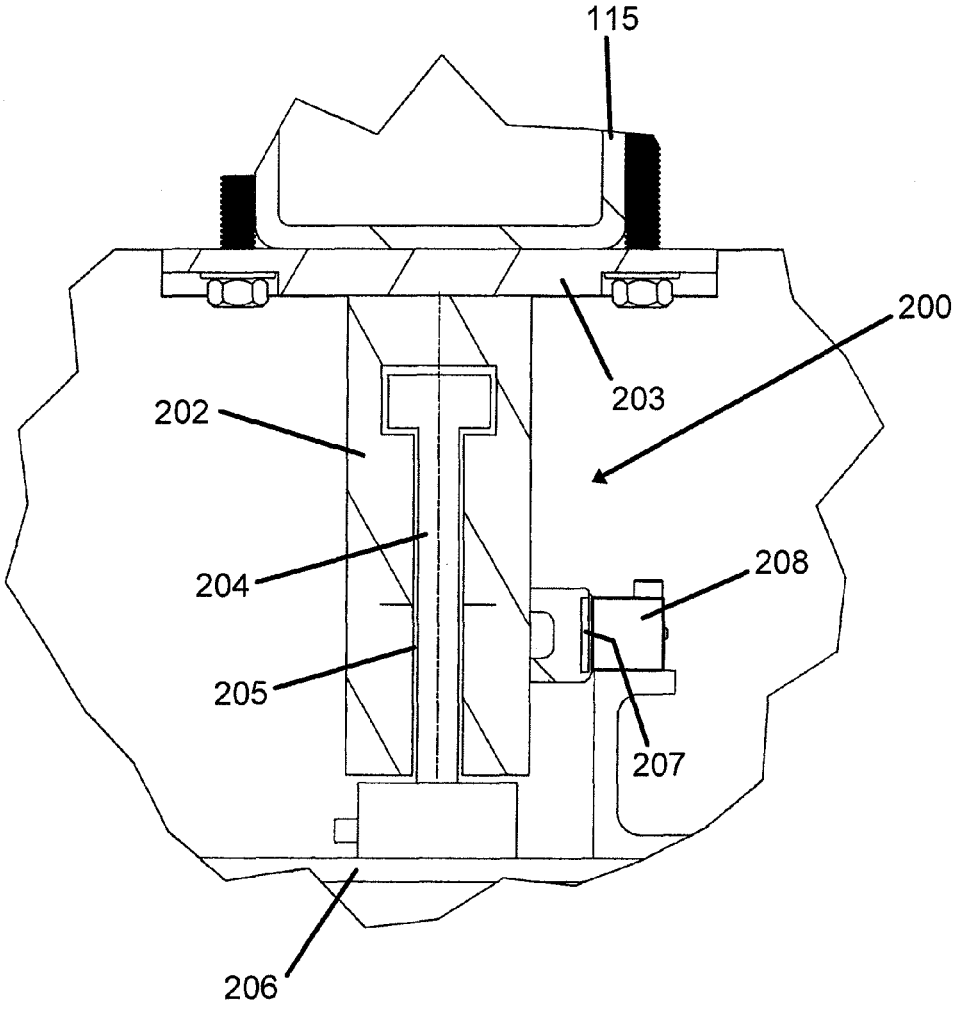
FIG. 5 is a detail view of a portion of FIG. 4, partly sectioned and on an enlarged scale relative to FIG. 4.

The apparatus 100 includes a linear movement mechanism for positioning the air-blasting units 140, 150. In one embodiment, the mechanism comprises a linear motor assembly 200. The linear motor assembly 200 comprises a stationary linear platen 202 affixed via a mounting bracket 203 to an underside of the transverse beam member 115, and a pair (one for each air-blasting unit) of forcers 204 movable along the platen 202. The platen 202 is a generally rectangular prismatic body having a channel 205 extending down its middle, over the entire length of the platen. The channel 205 has a T-shaped cross-section as shown in FIG. 5. Each forcer 204 has a similar T-shaped cross-section of somewhat smaller dimensions than the channel 205 so that the forcer readily moves in the channel in the length direction of the platen 202.

Each forcer 204 is connected, via a mounting bracket 206, to the respective support arm 141 or 151 of the associated one of the air-blasting units 140, 150. Accordingly, as the forcer 204 is moved along the platen 202 by the linear motor's electronic controller (not shown), the air-blasting unit 140 or 150 attached to the forcer 204 is moved along the linear bearing shafts 123, 124.

The linear motor 200 also includes a linear encoder scale 207 affixed to the platen 202 and extending parallel thereto. The mounting bracket 206 for each forcer 204 supports an absolute position encoder read head 208 for that forcer. Interaction between the encoder read head 208 and the encoder track 207 enables the linear motor's electronic controller to detect precisely where the encoder read head 208 (and, hence, the forcer 204) is located along the encoder track 207. The controller employs closed-loop control, based on signals from the encoder, to precisely position the forcer 204 at a desired location along the platen 202. Thus, each of the forcers 204, and hence their associated air-blasting units 140, 150, can be positioned as desired.

It will be understood that there are various linear motor technologies (e.g., brushless, brush-type, permanent magnet, induction, stepper-type, etc.) known in the art. In a preferred embodiment, each linear motor 200 comprises a brushless, cog-free linear motor in which the forcers 204 comprise primary coils and the platen 202 comprises a magnet track (secondary); however, any of the other technologies noted above can be used in embodiments of the present invention.

The ripsaw 10 can be equipped with a system of optical scanners (not shown) that scan an incoming board to determine its width, among other characteristics of the board. The ripsaw's controller can be programmed with logic to determine how to achieve an optimum yield from the board, given its detected width. The optimum yield may entail, for example, sawing the board into a determined number of equal-width boards, or it may entail sawing the board into a determined number of boards differing in width from one another. Because the incoming boards being fed one after another through the ripsaw 10 can vary in width and/or lateral position, the lateral positions of the waste strips 40, 50 can vary from one board to the next. The controller commands the linear motor 200 to position the air-blasting units 140, 150 as needed in order to effectively divert the waste strips from the usable boards.

It will be understood that each of the air nozzles 142, 143, 144, 145, 152, 153, 154, 155 is connected via its own hose (not shown) to a suitable source of pressurized air (not shown). The air source includes controllable valves for regulating the delivery of pressurized air through each hose to the respective nozzle. The valves can be under the control of a controller (not shown), which can be the same controller that controls the linear motor 200, such that air is discharged from each nozzle only when there is a waste strip to be diverted. The controller can regulate the air nozzles to operate in any fashion effective for separating the waste strips 40, 50 from the usable board(s) 30 and moving them laterally away from the usable board(s). For example, all air nozzles can be operated simultaneously for a certain period of time, or the air nozzles can be staged such that a subset of the nozzles operates first and then a different subset of the nozzles operates either sequentially after or simultaneously with the first subset. As an example, the upstream nozzles 142, 143, 152, 153 can be operated first, when a leading end of the sawn board has reached the longitudinal location of the upstream nozzles, while the downstream nozzles 144, 145, 154, 155 are inactive; thereafter, as the board continues to be advanced by the conveyor 20 and reaches the location of the downstream nozzles, the downstream nozzles can be operated, and the upstream nozzles can either continue to operate or can be deactivated.

The waste strips 40, 50 diverted by the apparatus 100 can be routed to a waste conveyor 220 (FIG. 3). For example, as shown in FIGS. 2 and 3, the apparatus can include a left-side chute 221 and a right-side chute 222 respectively positioned to receive the waste strips diverted by the left-side air-blasting unit 140 and the right-side air-blasting unit 150. The chutes 221, 222 are configured to route the waste strips down onto the waste conveyor 220. Thus, the usable board(s) 30 are conveyed by the main conveyor 20 and the waste strips 40, 50 are conveyed along a separate path by the waste conveyor 220. In the illustrated embodiment, the waste conveyor 220 is located directly below the main outfeed conveyor 20.

The air nozzles 142, 143, 144, 145, 152, 153, 154, 155 preferably are mounted on the support arms 141, 151 in a manner allowing the longitudinal positions of the nozzles to be adjusted as needed for most-effective operation, and/or allowing the operator to add or remove air nozzles as needed. For example, each air nozzle can be mounted on the respective support arm by a bracket attached to a clamp that can be loosened to allow the assembly to be slid to a new position along the arm (or to be removed from the arm if the nozzle is not needed or requires replacement for any reason), and then tightened to fix the assembly in a desired location on the arm.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for use in a ripsawing operation in which an incoming board is fed lengthwise along a longitudinal direction into a ripsaw and is sawn to produce one or more usable boards and in which opposite edges of the incoming board are removed to become two waste strips, the usable board(s) and the waste strips being carried away from the ripsaw atop an outfeed conveyor that conveys the usable board(s) and the waste strips in the longitudinal direction, the method being for removing the waste strips and diverting the waste strips along paths different from that of the usable board(s), the method comprising the steps of:

positioning at least one first air nozzle generally above the outfeed conveyor and at least one second air nozzle generally above the outfeed conveyor;

directing air from the at least one first air nozzle to impinge on one of the waste strips and move the waste strip laterally and away from one side of the usable board(s); and directing air from the at least one second air nozzle to impinge on the other waste strip to move the waste strip laterally and away from the other side of the usable board(s).

2. The method of claim 1, wherein the positioning step comprises using a linear movement mechanism to independently adjust the positions of the first and second air nozzles with respect to a lateral direction that is generally transverse to the longitudinal direction, such that the at least one first air nozzle's position corresponds to a position of the one waste strip and the at least one second air nozzle's position corresponds to a position of the other waste strip.

3. The method of claim 2, wherein the step of using the linear movement mechanism comprises using a linear motor comprising a platen extending parallel to the lateral direction and first and second forcers movable along the platen, wherein movement of the first forcer along the platen is used for imparting movement to the at least one first air nozzle and movement of the second forcer along the platen is used for imparting movement to the at least one second air nozzle, the positioning step comprising actuating the linear motor to cause the forcers to be moved to commanded positions along the platen, thereby adjusting the positions of the air nozzles.

4. The method of claim 3, wherein, in response to a change in the position of one or both of the waste strips in comparison to the positions of previous waste strips from a previous ripsawing operation, the linear motor is actuated to move one or both of the first and second air nozzles to new position(s).

5. The method of claim 4, wherein the change in the position of one or both of the waste strips is detected by at least one detector.

6. The method of claim 5, wherein the at least one detector provides an indication of the position of each of the waste strips with respect to the lateral direction, and said indication is used for controlling the linear motor.

7. In a ripsawing operation in which an incoming board is fed lengthwise along a longitudinal direction into a ripsaw and is sawn to produce one or more usable boards and in which opposite edges of the incoming board are removed to become two waste strips, the usable board(s) and the waste strips being carried away from the ripsaw atop an outfeed conveyor that conveys the usable board(s) and the waste strips in the longitudinal direction, an apparatus for removing the waste strips and diverting the waste strips along paths different from that of the usable board(s), the apparatus comprising:

a first air-blasting unit comprising one or more first air nozzles;

a second air-blasting unit comprising one or more second air nozzles; and a positioning mechanism that positions the first and second air-blasting units generally above the outfeed conveyor, the positioning mechanism comprising a linear movement mechanism operable for independently adjusting the positions of the first and second air-blasting units with respect to a lateral direction that is generally transverse to the longitudinal direction, such that air from the first air nozzle(s) impinges on one of the waste strips to move the waste strip laterally and away from one side of the usable board(s), and air from the second air nozzle(s) impinges on the other waste strip to move the waste strip laterally and away from the other side of the usable board(s).

8. The apparatus of claim 7, wherein the linear movement mechanism comprises a linear motor, the linear motor comprising a platen extending parallel to the lateral direction and first and second forcers movable along the platen, the first forcer being fastened to the first air-blasting unit and the second forcer being fastened to the second air-blasting unit, such that actuation of the linear motor causes the forcers to be moved to commanded positions along the platen, thereby adjusting the positions of the air-blasting units.

9. The apparatus of claim 8, wherein the linear motor comprises a brushless linear motor, the at least one platen comprising a magnet track and the forcers comprising primary coils.

10. The apparatus of claim 9, wherein the positioning mechanism includes a linear bearing assembly having at least a first linear bearing shaft extending parallel to the platen, the first and second air-blasting units engaging the first linear bearing shaft so as to be slidable therealong in the lateral direction.

11. The apparatus of claim 10, wherein the first air-blasting unit comprises a plurality of first air nozzles, and the second air-blasting unit comprises a plurality of second air nozzles.

12. The apparatus of claim 11, wherein the first air nozzles include at least one downwardly aimed air nozzle for separating the respective waste strip from the usable board(s) and at least one downwardly and laterally outwardly aimed air nozzle for moving the waste strip laterally and away from the usable board(s), and wherein the second air nozzles include at least one downwardly aimed air nozzle for separating the respective waste strip from the usable board(s) and at least one downwardly and laterally outwardly aimed air nozzle for moving the waste strip laterally and away from the usable board(s).

13. The apparatus of claim 12, wherein the first air-blasting unit comprises a longitudinally extending first support arm, with the first air nozzles being mounted on the first support arm, and the second air-blasting unit comprises a longitudinally extending second support arm, with the second air nozzles being mounted on the second support arm.

14. The apparatus of claim 13, wherein the first air nozzles comprise an upstream pair of downwardly aimed and downwardly and laterally outwardly aimed air nozzles mounted on an upstream portion of the first support arm and a downstream pair of downwardly aimed and downwardly and laterally outwardly aimed air nozzles mounted on a downstream portion of the first support arm, and the second air nozzles comprise an upstream pair of downwardly aimed and downwardly and laterally outwardly aimed air nozzles mounted on an upstream portion of the second support arm and a downstream pair of downwardly aimed and downwardly and laterally outwardly aimed air nozzles mounted on a downstream portion of the second support arm.

15. The apparatus of claim 12, wherein the linear bearing assembly includes a second linear bearing shaft extending parallel to the platen and longitudinally spaced from the first linear bearing shaft, each of the first and second support arms being slidably connected to the first and second linear bearing shafts.

16. The apparatus of claim 7, further comprising at least one detection device operable to detect a location of each of the waste strips with respect to the lateral direction, the detected locations of the waste strips being used for positioning of the first and second air-blasting units.

17. An arrangement comprising:

a ripsaw operable to receive an incoming board fed lengthwise along a longitudinal direction into the ripsaw and to saw the board into one or more usable boards and to separate opposite edges of the incoming board, which become two waste strips;

an outfeed conveyor adjacent a discharge side of the ripsaw for receiving the usable board(s) and the waste strips atop the outfeed conveyor and carrying the usable board (s) and the waste strips in the longitudinal direction away from the ripsaw; and an apparatus for removing the waste strips and diverting the waste strips along paths different from that of the usable board(s), the apparatus comprising:

a first air-blasting unit comprising one or more first air nozzles;

a second air-blasting unit comprising one or more second air nozzles; and a positioning mechanism that positions the first and second air-blasting units generally above the outfeed conveyor, the positioning mechanism comprising a linear movement mechanism operable for independently adjusting the positions of the first and second air-blasting units with respect to a lateral direction that is generally transverse to the longitudinal direction, such that air from the first air nozzle(s) impinges on one of the waste strips to move the waste strip laterally and away from one side of the usable board (s), and air from the second air nozzle(s) impinges on the other waste strip to move the waste strip laterally and away from the other side of the usable board(s).

18. The arrangement of claim 17, wherein the linear movement mechanism comprises a linear motor, the linear motor comprising a platen extending parallel to the lateral direction and first and second forcers movable along the platen, the first forcer being fastened to the first air-blasting unit and the second forcer being fastened to the second air-blasting unit, such that actuation of the linear motor causes the forcers to be moved to commanded positions along the platen, thereby adjusting the positions of the air-blasting units.

19. The arrangement of claim 18, wherein the linear motor comprises a brushless linear motor, the at least one platen comprising a magnet track and the forcers comprising primary coils.

20. The arrangement of claim 17, further comprising a waste conveyor for conveying the waste strips along a path different from that along which the outfeed conveyor conveys the usable board(s).

21. The arrangement of claim 20, further comprising a pair of side chutes positioned respectively at opposite sides of the outfeed conveyor, the side chutes being configured for receiving the waste strips diverted by the air-blasting units and routing the waste strips onto the waste conveyor.

* * * * *